US007530797B2

(12) United States Patent
Ito et al.

(10) Patent No.: US 7,530,797 B2
(45) Date of Patent: May 12, 2009

(54) VARIABLE DISPLACEMENT COMPRESSOR

(75) Inventors: Masafumi Ito, Kariya (JP); Sokichi Hibino, Kariya (JP); Shiro Hayashi, Kariya (JP); Junichi Takahata, Kariya (JP); Takayuki Ohara, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 423 days.

(21) Appl. No.: 11/175,792

(22) Filed: Jul. 5, 2005

(65) Prior Publication Data

US 2006/0008359 A1 Jan. 12, 2006

(30) Foreign Application Priority Data

Jul. 9, 2004 (JP) ..... 2004-203520

(51) Int. Cl.
*F04B 1/26* (2006.01)

(52) U.S. Cl. ..... 417/222.2; 417/222.1

(58) Field of Classification Search ..... 417/222.2, 417/222.1, 269; 92/12.1, 12.2; 91/505
See application file for complete search history.

(56) References Cited

U.S. PATENT DOCUMENTS 3,722,858 A * 3/1973 Sugimoto et al. ..... 251/209
4,005,948 A * 2/1977 Hiraga et al. ..... 417/269
4,236,878 A * 12/1980 Terauchi ..... 417/269
4,641,570 A * 2/1987 Futamura et al. ..... 92/71
4,685,866 A 8/1987 Takenaka et al. ..... 417/222
4,729,719 A 3/1988 Kayukawa et al. ..... 417/222
5,231,914 A * 8/1993 Hayase et al. ..... 92/12.2
5,267,839 A * 12/1993 Kimura et al. ..... 417/269
5,286,173 A * 2/1994 Takenaka et al. ..... 417/269
5,318,410 A * 6/1994 Kawamura et al. ..... 417/222.2
5,342,178 A * 8/1994 Kimura et al. ..... 417/269
5,478,212 A * 12/1995 Sakai et al. ..... 417/269
5,498,140 A * 3/1996 Kawaguchi et al. ..... 417/199.1
5,529,461 A * 6/1996 Kawaguchi et al. ..... 417/222.2
5,624,240 A * 4/1997 Kawaguchi et al. ..... 417/222.2
5,674,054 A * 10/1997 Ota et al. ..... 417/269
5,779,004 A * 7/1998 Hoshino et al. ..... 184/6.17
5,842,834 A * 12/1998 Kawaguchi et al. ..... 417/222.2
5,937,735 A * 8/1999 Shimizu et al. ..... 92/153

(Continued)

FOREIGN PATENT DOCUMENTS

DE 40 33 422 4/1992

(Continued)

*Primary Examiner*—Devon C Kramer
*Assistant Examiner*—Alexander B Comley
(74) *Attorney, Agent, or Firm*—Locke Lord Bissell & Liddell, LLP

(57) ABSTRACT

A variable displacement compressor including a drive shaft through which a gas passage extends between front and rear ends of the drive shaft. The gas passage is connected to a suction chamber at the rear end of the drive shaft. The drive shaft includes a first gas inlet passage, which connects the gas passage to a crank chamber through a lip seal, an oil chamber, and a thrust bearing, and a second gas inlet passage, which connects the gas passage to a central portion of the crank chamber. The drive shaft further includes a sleeve movable along the drive shaft as a swash plate inclines to adjust an open amount of the second gas inlet passage in accordance with the inclination angle of the swash plate, that is, the displacement of the compressor.

10 Claims, 8 Drawing Sheets

U.S. PATENT DOCUMENTS

| | | | | | |
|---|---|---|---|---|---|
| 5,988,040 | A | * | 11/1999 | Ota et al. | 92/12.2 |
| 6,030,174 | A | * | 2/2000 | Maier et al. | 415/151 |
| 6,102,669 | A | * | 8/2000 | Fujita | 417/222.2 |
| 6,135,722 | A | * | 10/2000 | Kawaguchi et al. | 417/222.2 |
| 6,149,397 | A | * | 11/2000 | Mizutani et al. | 417/222.2 |
| 6,224,349 | B1 | * | 5/2001 | Iwanami et al. | 417/269 |
| 6,227,812 | B1 | * | 5/2001 | Kawaguchi et al. | 417/222.2 |
| 6,283,722 | B1 | * | 9/2001 | Takenaka et al. | 417/222.2 |
| 6,318,971 | B1 | * | 11/2001 | Ota et al. | 417/222.2 |
| 6,402,480 | B1 | * | 6/2002 | Sud et al. | 417/222.1 |
| 6,648,605 | B2 | * | 11/2003 | Nelson | 417/53 |
| 6,675,596 | B2 | * | 1/2004 | Iwanami et al. | 62/236 |
| 2003/0026708 | A1 | * | 2/2003 | Ota et al. | 417/222.2 |
| 2003/0095876 | A1 | * | 5/2003 | Tarutani et al. | 417/269 |
| 2003/0113211 | A1 | | 6/2003 | Moroi et al. | 417/222.2 |
| 2004/0005223 | A1 | * | 1/2004 | Kawachi et al. | 417/222.1 |
| 2004/0170504 | A1 | * | 9/2004 | Murakami et al. | 417/222.1 |
| 2006/0008359 | A1 | * | 1/2006 | Ito et al. | 417/222.2 |

FOREIGN PATENT DOCUMENTS

| | | | | |
|---|---|---|---|---|
| EP | 0 896 153 | | | 2/1999 |
| JP | 61-255285 | | | 11/1986 |
| JP | 61255285 | A | * | 11/1986 |
| JP | 2-5771 | | | 1/1990 |
| JP | 6-213180 | | | 8/1994 |
| JP | 8-35485 | | | 2/1996 |
| JP | 11-62824 | | | 3/1999 |
| JP | 2000-297746 | | | 10/2000 |
| JP | 2002213350 | A | * | 7/2002 |

* cited by examiner

VARIABLE DISPLACEMENT COMPRESSOR

BACKGROUND OF THE INVENTION

The present invention relates to a piston type variable displacement compressor.

Japanese Patent Laid-Open Publication No. 11-62824 and Japanese Patent Laid-Open Publication No. 2000-297746 describe examples of various displacement compressors. According to the technology described in Japanese Patent Laid-Open Publication No. 11-62824, a sleeve is fitted to a drive shaft to be slidable in the axial direction of the drive shaft. The sleeve is coupled to a swash plate. The sleeve moves axially along the drive shaft in accordance with the inclination angle of the swash plate. The drive shaft includes a gas passage which opens at the rear end of the drive shaft. The front end of the gas passage is connected to the interior of a crank chamber through a gas inlet passage extending through the drive shaft. The gas passage and the gas inlet passage form part of a bleed passage that connects the crank chamber to a suction chamber. The sleeve is designed to adjust the open amount of the gas inlet passage in accordance with the inclination angle of the swash plate. Specifically, the open amount of the gas inlet passage is adjusted to be maximal when the inclination angle of the swash plate is greatest and adjusted to be minimal when the inclination angle of the swash plate is smallest. Accordingly, the open amount of the gas inlet passage decreases as the inclination angle of the swash plate decreases when the displacement is decreased. This limits the amount of refrigerant gas that bleeds from the crank chamber towards the suction chamber through the gas inlet passage. As a result, the pressure of the crank chamber is increased.

According to the technology described in Japanese Patent Laid-Open Publication No. 2000-297746, a gas passage extending axially through a drive shaft. The front end of the gas passage is connected to an oil chamber by a first gas inlet passage extending through the front end of the drive shaft. The oil chamber is for collecting lubricating oil, which lubricates a front bearing and a lip seal. The front end of the gas passage is further connected to a crank chamber via the oil chamber. The rear end of the gas passage is directly connected to a rear region of the crank chamber by a second gas inlet passage extending through the rear end of the drive shaft. The rear end of the gas passage is further connected to a suction chamber. Thus, the gas passage forms part of a bleed passage. The drive shaft also supports a sleeve which moves along the drive shaft as it follows the inclination of a cam plate to open or close the second gas inlet passage according to the inclination angle of the cam plate. The sleeve closes the second gas inlet passage when the inclination angle of the cam plate relative to the drive shaft becomes minimal, that is, when the displacement is controlled to be minimal.

The interior of the compressor is lubricated with lubricating oil that circulates within the compressor together with refrigerant gas. There are cam plate-type compressors that use blow-by gas for positively supplying lubricating oil to a bearing, which supports the front end of a drive shaft, and to a seal device, which seals the space between the front end of the drive shaft and the compressor housing. The blow-by gas is discharged into a crank chamber from between a cylinder bore and a piston as the piston reciprocates. More specifically, the lubricating oil collected in the crank chamber is scattered in the crank chamber by the oscillation of the cam plate. The blow-by forces the scattered lubricating oil to the front of the crank chamber and positively supplies the lubrication oil to the bearing and a seal device. The amount of the blow-by gas increases as the piston stroke becomes longer, that is, as the displacement increases.

In the technology described in Japanese Patent Laid-Open Publication No. 11-62824, the amount of blow-by gas is minimal when the compressor displacement is minimal. Therefore, the lubricating oil supplied to the front bearing and the seal device by the blow-by gas will become insufficient, and the bearing and the seal device may not be sufficiently lubricated. As a result, in a clutchless compressor that substantially stops operating when the displacement is minimal, the durability of the compressor may be decreased.

In the technology described in Japanese Patent Publication No. 2000-297746, when the compressor displacement is minimal, the second gas inlet passage is closed when the first gas inlet passage is open. Thus, refrigerant gas mainly including blow-by gas is introduced into the gas passage through the first gas inlet passage. Therefore, even when the clutchless compressor stops operating, lubricating oil is positively supplied to the bearing and the seal device at the front end of the drive shaft by the refrigerant gas mainly including blow-by gas. This ensures the lubrication of the bearing and the seal device.

However, in the technology described in Japanese Patent Publication No. 2000-297746, the second gas inlet passage is not closed by the sleeve when the displacement of the compressor is controlled is significantly greater than the minimum state. Therefore, the refrigerant gas mainly including blow-by gas will bleed not only through the first gas inlet passage but also through the second gas inlet passage. Unless the amount of the refrigerant gas introduced into the gas passage through the first gas inlet passage is restricted, the amount of lubricating oil that is sent from the crank chamber to the suction chamber by the refrigerant gas will increase. This will increase the proportion of the lubricating oil in the refrigerant gas circulating through an external refrigerant circuit and decrease the heat exchange efficiency of an expansion device. As a result, the cooling capacity of an air conditioner will be decreased.

SUMMARY OF THE INVENTION

Accordingly, it is an object of the present invention to provide a variable displacement compressor that lubricates the interior of a compressor in a desirable manner and controls the proportion of lubricating oil in an external refrigerant circuit in a satisfactory manner.

One aspect of the present invention is a variable displacement compressor for use with a refrigerant gas. The variable displacement compressor includes a cam plate. A crank chamber includes a drive shaft and a piston in which the cam plate is arranged in the crank chamber for operably connecting the drive shaft and the piston. The crank chamber is supplied with the refrigerant gas at high pressure from a refrigerant gas discharge region while refrigerant gas bleeds from the crank chamber to a suction chamber through a bleed passage so as to adjust internal pressure of the crank chamber. The cam plate is adjustable to incline at an inclination angle that is in accordance with the internal pressure of the crank chamber in order to change the stroke of the piston. A gas passage formed in the drive shaft extends in an axial direction of the drive shaft and connects to the suction chamber. A bearing device and a seal device are arranged at a front end portion of the drive shaft. An oil lubrication passage lubricates the bearing device and the seal device. A first gas inlet passage connects the gas passage and the crank chamber via the oil lubrication passage. A second gas inlet passage directly connects the gas passage and the crank chamber. A sleeve is supported on the drive shaft and moved in the axial direction of the drive shaft as the cam plate inclines to change an open amount of the second gas inlet passage. The open amount of the second gas inlet passage is changed by the sleeve to adjust the amount of refrigerant gas drawn into the gas passage through the first gas inlet passage.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 4(*b*) is a cross-sectional view taken along the line 4B-4B in FIG. 4(*a*);

DETAILED DESCRIPTION OF THE PREFERRED EMBODIMENTS

A clutchless variable displacement compressor 10, for use in a vehicle air conditioner, according to a preferred embodiment of the present invention will now be described with reference to FIGS. 1 to 6.

Figure 1:
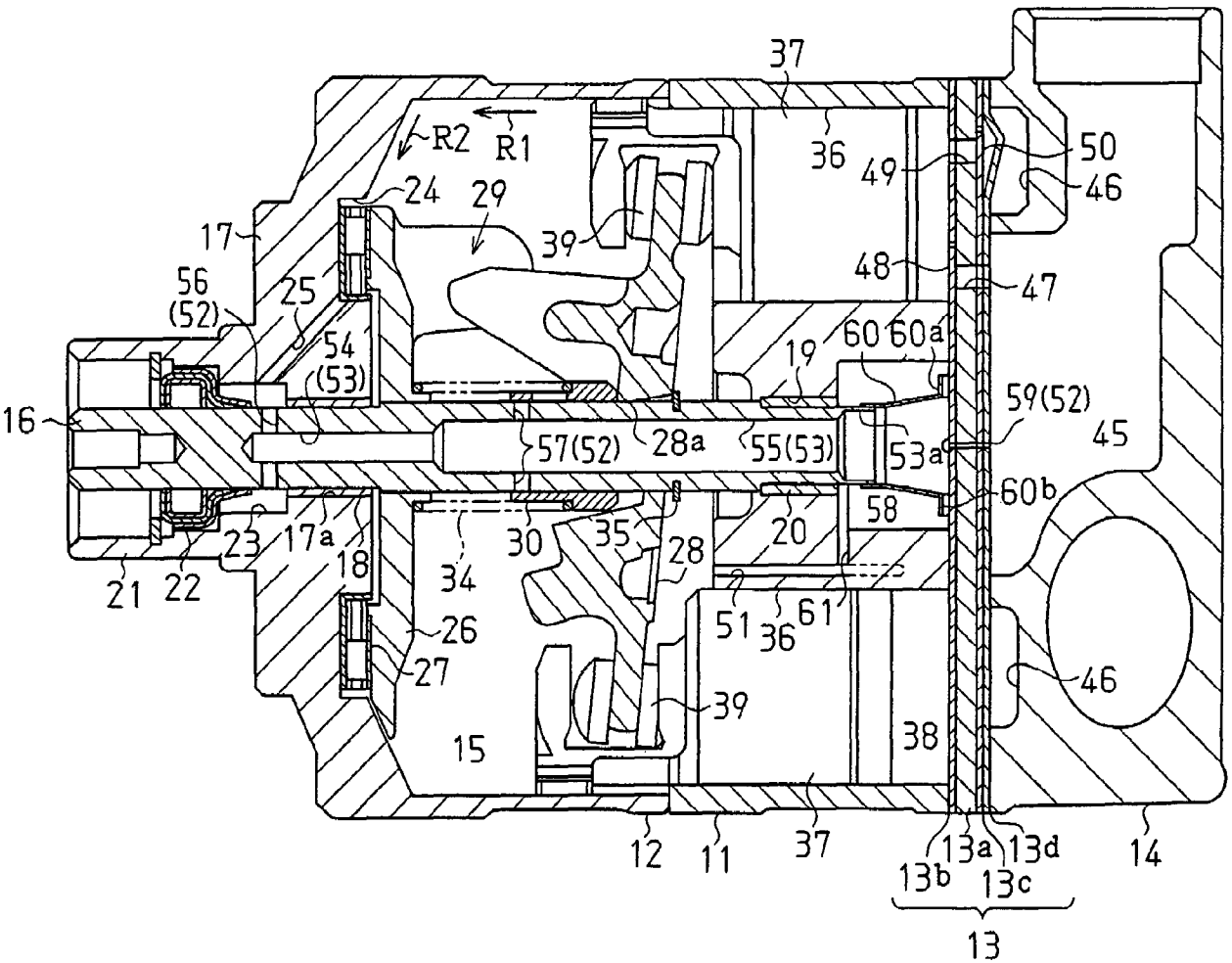
FIG. 1 is a cross-section view of a compressor according to a preferred embodiment of the present invention.

FIG. 1 is a cross-sectional view showing a variable displacement compressor (hereafter, simply referred to as a "compressor") 10. The left side as viewed in FIG. 1 corresponds to the front of the compressor 10, and the right side corresponds to the rear of the compressor 10.

A compressor housing is formed by a cylinder block 11, a front housing 12 coupled to the front end of the cylinder block 11, and a rear housing 14 coupled to the rear end of the cylinder block 11 with a valve/port plate 13 arranged therebetween A crank chamber 15 is defined between the cylinder block 11 and the front housing 12. A drive shaft 16 is rotatably supported in the crank chamber 15. The drive shaft 16 is connected to a vehicle engine (not shown). A support hole 17*a* extends through a front wall 17 of the front housing 12. A plane bearing 18 is fitted in the support hole 17*a* to support the front end of the drive shaft 16. A support hole 19 extends through the center of the cylinder block 11. A plane bearing 20 is fitted in the support hole 19 to support the rear end of the drive shaft 16. The front end of the drive shaft 16 projects into a tubular portion 21, which extends from the front wall 17 of the front housing 12. A lip seal 22 is arranged in the tubular portion 21. The lip seal 22 is in contact with the peripheral surface of the front end of the drive shaft 16. An oil chamber 23 is defined between the front wall 17 of the front housing 12 and the tubular portion 21. Lubricating oil for lubricating the portion between the drive shaft 16 and the lip seal 22 is stored in the oil chamber 23. The oil chamber 23 is connected to the bottom of an annular groove 24 formed in the inner surface of the front wall 17 of the front housing 12 via an oil passage 25.

A lug plate 26 is fixed to the drive shaft 16 to rotate integrally with the drive shaft 16 inside the crank chamber 15. The lug plate 26 is supported on the inner surface of the front wall 17 of the front housing 12 by a thrust bearing 27, which is accommodated in the annular groove 24. In this embodiment, the plane bearing 18 and the thrust bearing 27 form a bearing device.

The drive shaft 16 extends through a through hole 28*a* formed in the central portion of a swash plate 28, or cam plate. The swash plate 28 is coupled to the lug plate 26 by means of a hinge mechanism 29. The swash plate 28 is rotated integrally with the lug plate 26 and the drive shaft 16. Further, the swash plate 28 is inclined relative to the drive shaft 16 while moving in the axial direction of the drive shaft 16. This changes the angle of the swash plate 28 relative to a plane orthogonal to the axis of the drive shaft 16 (hereafter, referred to as "the inclination angle"). The maximum inclination angle of the swash plate 28 is determined by the abutment between the swash plate 28 and the lug plate 26.

Figure 4A:
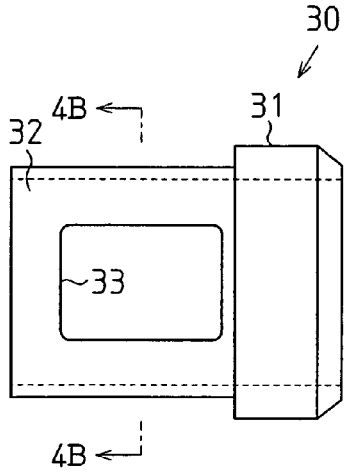
FIG. 4(*a*) is a side view showing a sleeve.
Figure 4B:
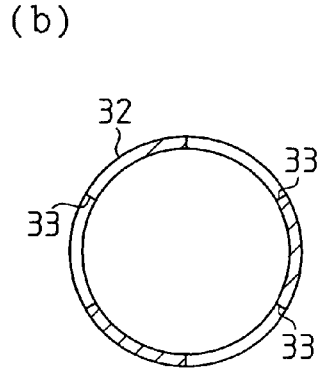

A sleeve 30 is fitted on the drive shaft 16 between the lug plate 26 and the swash plate 28. The sleeve 30 is rotatable relative to the drive shaft 16 and is supported by the drive shaft 16 to be movable in the axial direction of the drive shaft 16. As shown in FIGS. 4(*a*) and 4(*b*), the rear end of the sleeve 30 includes an abutment portion 31 having a taper abut against the front surface of the swash plate 28. The front of the sleeve 30 defines a tubular portion 32. The tubular portion 32 has three substantially rectangular openings 33, which are arranged at equal intervals about the axis of the tubular portion 32.

Figure 2:
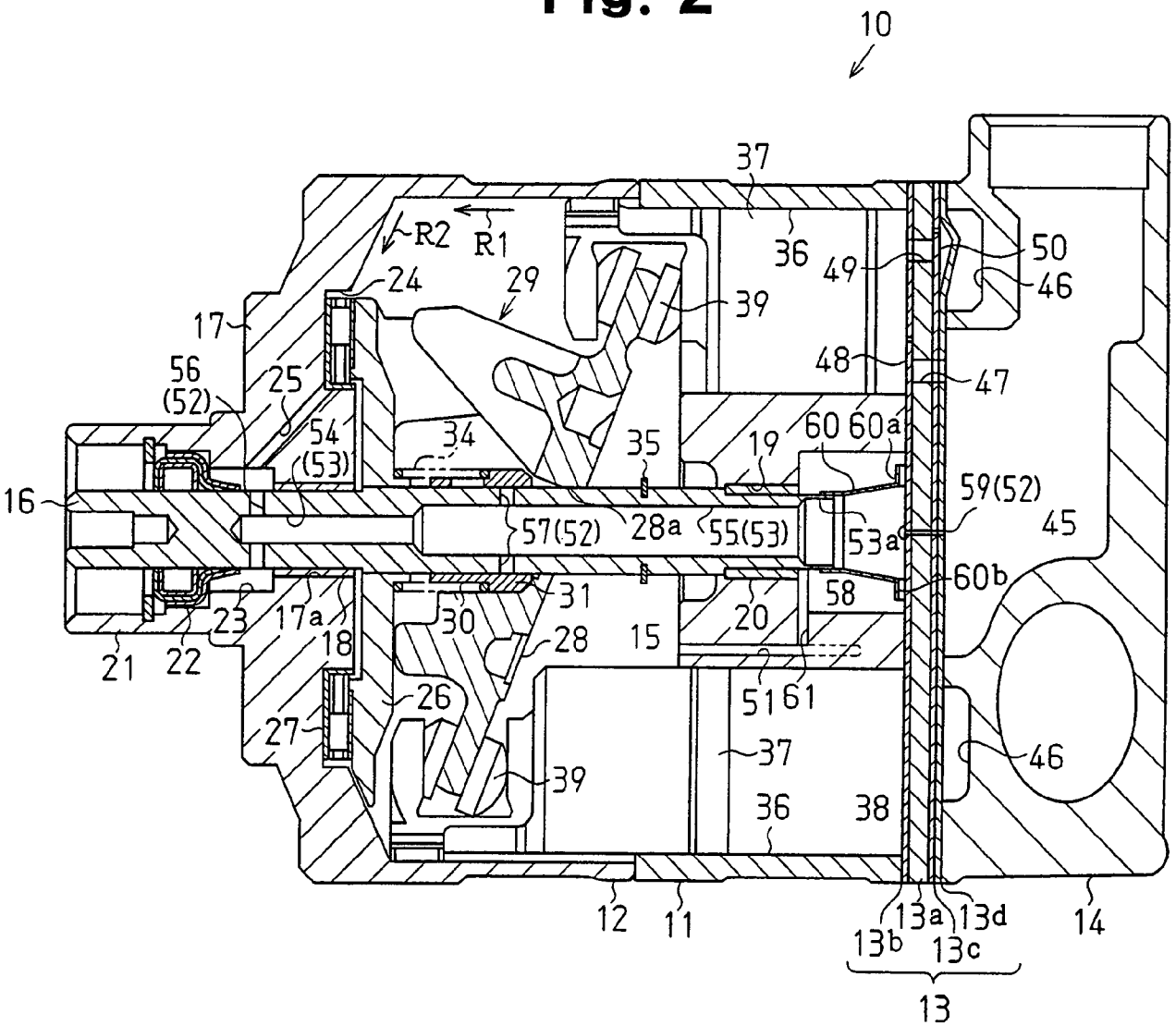
FIG. 2 is a cross-sectional view showing a state in which the inclination angle of a swash plate is maximum.
Figure 3:
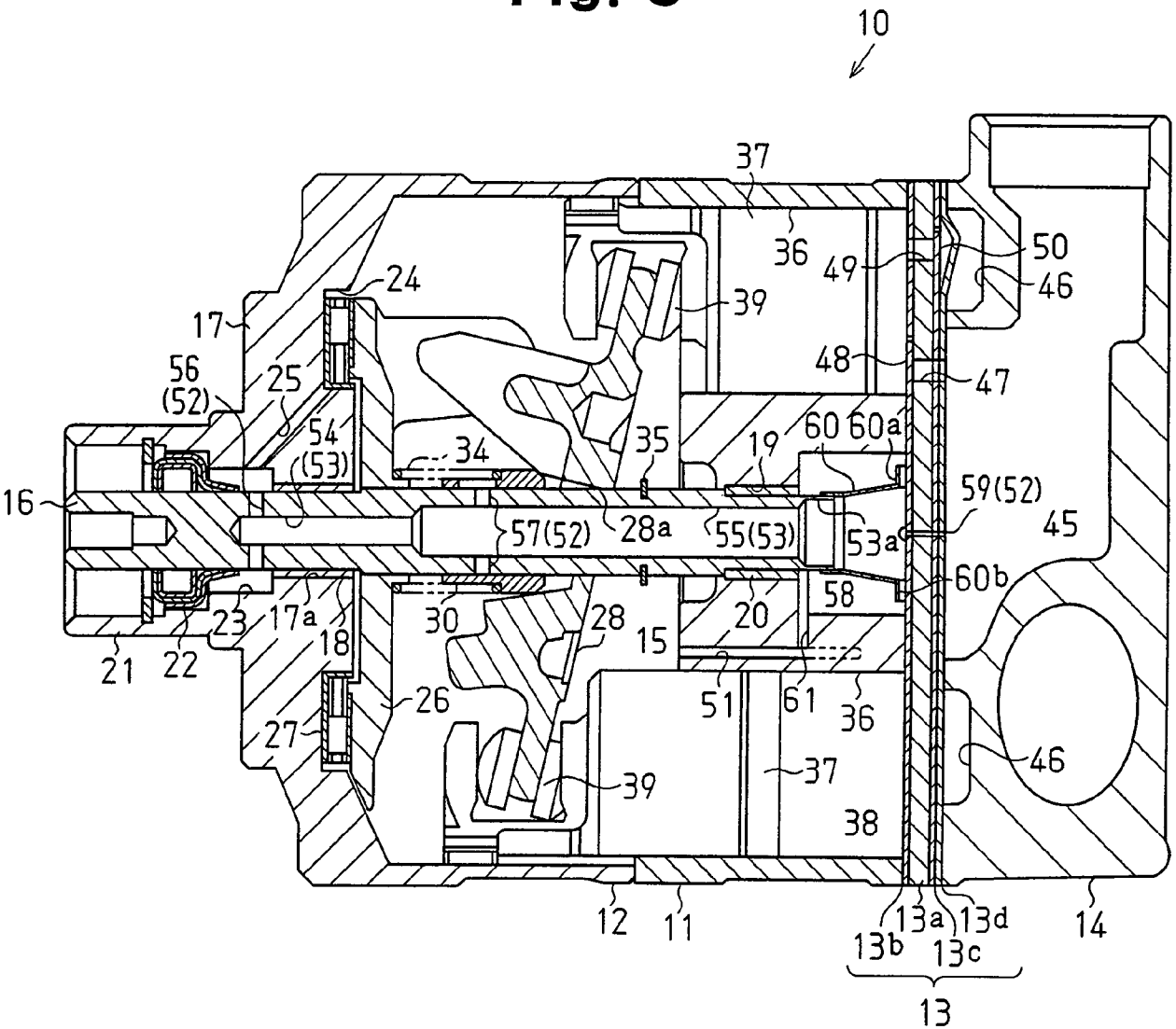
FIG. 3 is a cross-sectional view showing a state in which the inclination angle of the swash plate is set between the maximum and minimum angles.

As shown in FIGS. 1, 2, and 3, a coil spring 34 is fitted on the drive shaft 16 between the swash plate 28 and the lug plate 26. The coil spring 34 biases the swash plate 28 in a direction decreasing the inclination angle. A minimum inclination angle restriction member 35 is provided on the drive shaft 16 between the swash plate 28 and the cylinder block 11 to restrict the minimum inclination angle of the swash plate 28 by abutting against the swash plate 28.

A plurality of cylinder bores 36 extends through the cylinder block 11 at regular angular intervals around the drive shaft 16. The rear end of each cylinder bore 36 is closed by the valve/port plate 13. The valve/port plate 13 includes a valve plate 13*a*, a suction valve plate 13*b* joined to the front surface of the valve plate 13*a*, a discharge valve plate 13*c* joined to the rear surface of the valve plate 13*a*, and a retainer plate 13*d* joined to the rear surface of the discharge valve plate 13*c*. A single-head piston 37 is reciprocated in each cylinder bore 36.

A compression chamber 38 is defined between each piston 37 and the valve/port plate 13. Each piston 37 is connected to the peripheral portion of the swash plate 28 by shoes 39. Rotation of the swash plate 28 reciprocates pistons 37 in the respective cylinder bores 36.

The rear housing 14 includes a suction chamber 45 and a discharge chamber 46 (discharge region), which are closed by the valve/port plate 13. The suction chamber 45 is connected to the discharge chamber 46 (discharge region) by an external refrigerant circuit (not shown). For each compression chamber 38, the valve/port plate 13 is provided with a suction port 47, which is connected with the suction chamber 45, and a suction valve 48, which opens and closes the suction port 47. Further, for each compression chamber 38, the valve/port plate 13 is provided with a discharge port 49, which is connected with the discharge chamber 46, and a discharge valve 50, which opens and closes the discharge port 49. A gas supply passage 51, which extends through the cylinder block 11 and the valve/port plate 13, connects the discharge chamber 46 to the crank chamber 15. A solenoid control valve (not shown) is arranged in the gas supply passage 51 to adjust the open amount of the gas supply passage 51. Further, a bleed passage 52 extends through the cylinder block 11, the front housing 12, and the valve/port plate 13 to connect the crank chamber 15 to the suction chamber 45. The bleed passage 52 will be described later in more detail.

The solenoid control valve is controlled by a controller (not shown) to adjust the open amount of the gas supply passage 51 and thus control the amount of high-pressure refrigerant gas drawn from the discharge chamber 46 into the crank chamber 15 through the gas supply passage 51. The amount of the high-pressure refrigerant gas drawn into the crank chamber 15 through the gas supply passage 51 is controlled in accordance with the amount of blow-by gas that leaks into the crank chamber 15 through the space between the cylinder bores 36 and the pistons 37 and the amount of refrigerant gas that is discharged from the crank chamber 15 through the bleed passage 52. This controls the pressure of the refrigerant gas within the crank chamber 15, which in turn, controls the inclination angle of the swash plate 28. The inclination angle is determined by the pressure of the refrigerant gas in the crank chamber 15 and the pressure of the refrigerant gas in the compression chambers 38. Further, the inclination angle of the swash plate 28 controls the stroke of the pistons 37 and thus controls the displacement of the compressor 10.

Figure 5A:
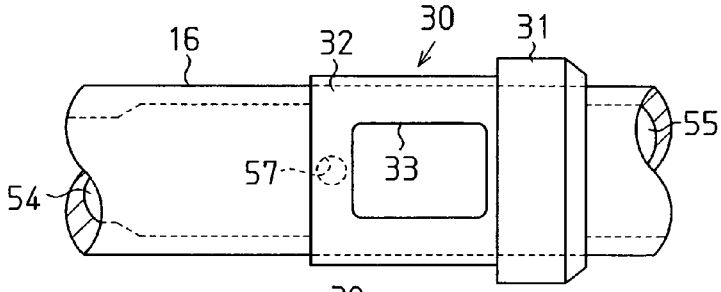
FIGS. 5(*a*), 5(*b*), and 5(*c*) are front views showing the sleeve and a drive shaft.
Figure 5B:
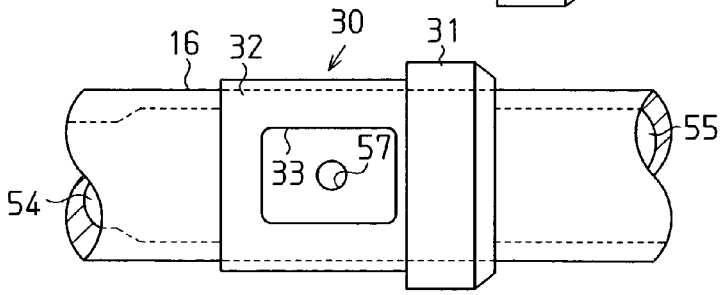
Figure 5C:
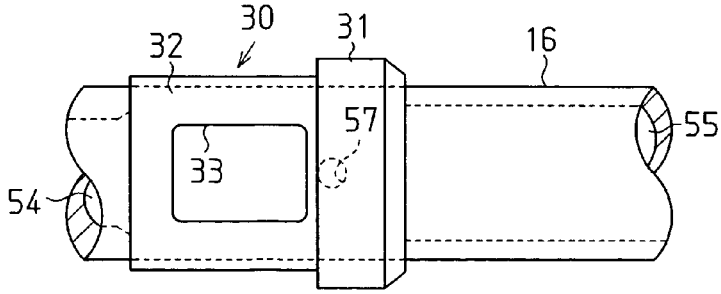

As shown in FIGS. 1 to 3, a gas passage 53 axially extends through the drive shaft 16 and opens at the rear end of the drive shaft 16. The gas passage 53 is formed by a small-diameter portion 54 and a large-diameter portion 55 (lubricating oil separation mechanism). The small-diameter portion 54 is located in the front part of the gas passage 53, and the large-diameter portion 55 between the rear end of the small-diameter portion 54 and the rear end of the drive shaft 16. The front of the drive shaft 16 includes a plurality of first gas inlet passages 56, which connect the front end of the small-diameter portion 54 to the oil chamber 23. The middle of the drive shaft 16 includes a plurality of second gas inlet passages 57, which directly connect the large-diameter portion 55 and the crank chamber 15 (in this embodiment, four second gas inlet passages 57 are provided at regular angular intervals). As shown in FIGS. 5(*a*), 5(*b*), and 5(*c*), the open amount of each second gas inlet passage 57 is changed by the sleeve 30 in accordance with the position of the sleeve 30 in the axial direction on the drive shaft 16. More specifically, as shown in FIG. 5(*a*), the second gas inlet passages 57 are closed by the front end of the tubular portion 32 (first closing portion) of the sleeve 30. The second gas inlet passages 57 are also closed, as shown in FIG. 5C, by the abutment portion 31 (second closing portion) of the sleeve 30. As shown in FIG. 5(*b*), the second gas inlet passages 57 are open due to the opening 33 (exposing portion). In the state shown in FIG. 5(*b*), at least three of the four second gas inlet passages 57 are open due to the openings 33 regardless of the rotational position of the sleeve 30 relative to the drive shaft 16. This is because three openings 33 are formed around the axis of the sleeve 30 at regular angular intervals, while the four second gas inlet passages 57 are formed around the axis of the drive shaft 16 at regular angular intervals.

As shown in FIGS. 1 to 3, the cylinder block 11 includes an oil chamber 58. The rear side of the oil chamber 58 is closed by the valve/port plate 13. An orifice 59 extending through the center of the valve/port plate 13 connects the oil chamber 58 to the suction chamber 45. The rear end of the drive shaft 16 is arranged in the oil chamber 58 so as to connect the gas passage 53 to the oil chamber 58.

In the oil chamber 58, an oil separator 60, which is generally tubular, is fitted on the rear end of the drive shaft 16. The oil separator 60 is formed such that its inner diameter increases from the front end, which is fixed to the drive shaft 16, towards the rear end. A flange 60*a* is formed on the rear end of the oil separator 60. When the flange 60*a* comes into contact with the valve/port plate 13, a plurality of spouts 60*b* are defined between the flange 60*a* and the valve/port plate 13 to connect the interior and exterior of the oil separator 60. The orifice 59 faces the oil separator 60. The bleed passage 52 is formed by the first gas inlet passages 56, the gas passage 53, the second gas inlet passages 57, the interior of the oil separator 60, and the orifice 59. Refrigerant gas bleeds from the crank chamber 15 to the suction chamber 45 through the bleed passage 52. The drive shaft 16 is allowed to move slightly in the axial direction. However, rearward movement of the drive shaft 16 is restricted when the flange 60*a* of the oil separator 60 abuts against the front surface of the valve/port plate 13. The oil chamber 58 is connected to the gas supply passage 51, which extends below the oil chamber 58, by a communication passage 61, which extends downwards from the front end of the oil chamber 58.

The operation of the compressor 10 will now be described.

As the drive shaft 16 rotates, the swash plate 28 reciprocates the pistons 37 in the respective cylinder bores 36. The reciprocation of the pistons 37 results in the repetition of a series of operations in which refrigerant gas is drawn from the suction chamber 45 into the compression chamber 38, the refrigerant gas is compressed in the compression chamber 38, and the compressed refrigerant gas is discharged from the compression chamber 38 to the discharge chamber 46. The compressed refrigerant gas discharged into the discharge chamber 46 is sent to the external refrigerant circuit.

The open amount of the solenoid control valve is adjusted to control the balance of the amount of high-pressure refrigerant gas drawn into the crank chamber 15 from the discharge chamber 46 through the gas supply passage 51, the amount of blow-by gas drawn into the crank chamber 15 from the cylinder bores 36, and the amount of refrigerant gas discharged from the crank chamber 15 to the suction chamber 45 through the bleed passage 52. This control determines the internal pressure of the crank chamber 15. A change in the internal pressure of the crank chamber 15 changes the difference between each side of the pistons 37, that is, the difference between the internal pressure of the crank chamber 15 and the average internal pressure of the compression chambers 38. This alters the inclination angle of the swash plate 28, which in turn, varies the stroke of the pistons 37, or the displacement of the compressor 10. In the compressor 10, the internal pressure of the suction chamber 45 is lower than that of the crank chamber 15, and the internal pressure of the crank chamber 15 is lower than that of the discharge chamber 46.

(Minimum Displacement Operation)

When the solenoid control valve controls the internal pressure of the crank chamber 15 so that the inclination angle of the swash plate 28 becomes minimal (minimum inclination range) as shown in the state of FIG. 1, the displacement of the compressor 10 becomes minimal. In this state, the clutchless compressor 10 substantially stops operating although the pistons 37 continue to reciprocate with a minimum stroke. Further, all the second gas inlet passages 57 are closed, as shown in FIG. 5(*a*), by the front end of the sleeve 30, which is moved towards the rear of the drive shaft 16. Thus, the second gas inlet passages 57 disconnect the gas passage 53 from the crank chamber 15.

In this state, when the pistons 37 reciprocate as the drive shaft 16 rotates, blow-by gas is released into the crank chamber 15 from between the cylinder bores 36 and the pistons 37. As shown by arrows R1 and R2 in FIG. 1, the blow-by gas flows towards the front in the crank chamber 15 and hits the inner surface of the front wall 17 of the front housing 12. The amount of the blow-by gas is minimal since the stroke of the piston 37 is minimal.

Since the internal pressure of the crank chamber 15 is higher than that of the suction chamber 45, the refrigerant gas moves from the crank chamber 15 into the suction chamber 45 through the bleed passage 52. Specifically, the crank chamber 15 is connected to the suction chamber 45 through the first gas inlet passages 56, the gas passage 53, the interior of the oil separator 60, and the orifice 59. Therefore, some of the blow-by gas reaching the inner surface of the front wall 17 of the front housing 12 is drawn into the oil chamber 23 from the annular groove 24 through the oil passage 25. The blow-by gas then flows from the oil chamber 23 into the gas passage 53 through the first gas inlet passages 56.

Accordingly, when the compressor 10 substantially stops operating and the amount of blow-by gas is minimal, refrigerant gas mainly including blow-by gas is positively drawn into the gas passage 53. Thus, lubricating oil is positively supplied by the refrigerant gas to the plane bearing 18, the lip seal 22, and the thrust bearing 27. Consequently, when the compressor 10 substantially stops operating, the plane bearing 18, the lip seal 22, and the thrust bearing 27 are lubricated in a satisfactory manner.

(Intermediate Displacement Operation)

When the solenoid control valve controls the internal pressure of the crank chamber 15 so that the inclination angle of the swash plate 28 is between the maximum and minimum inclination angles as shown in the state of FIG. 3, the displacement of the compressor 10 becomes between the maximum and minimum displacements. In this state., the second gas inlet passages 57 are open, as shown in FIG. 5(*b*), since the sleeve 30 is moved towards the front of the drive shaft 16. Thus, the second gas inlet passages 57 connect the gas passage 53 and the crank chamber 15.

In this state, the stroke of the piston 37 becomes greater than when the displacement is minimal. Therefore, the amount of the blow-by gas is also greater than when the displacement is minimal. Unlike when the displacement is minimal, the crank chamber 15 is connected to the suction chamber 45 not only through the first gas inlet passages 56, the gas passage 53, the interior of the oil separator 60, and the orifice 59, but also through the second gas inlet passages 57, the gas passage 53, the interior of the oil separator 60, and the orifice 59. Refrigerant gas mainly including blow-by gas is drawn from the first gas inlet passages 56 into the gas passage 53. Further, refrigerant gas around the drive shaft 16 is drawn into the gas passage 53 through the second gas inlet passages 57. The amount of the blow-by gas drawn into the gas passage 53 through the first gas inlet passages 56 is restricted by the refrigerant gas drawn into the gas passage 53 through the second gas inlet passages 57. Consequently, the amount of lubricating oil carried by the blow-by gas from the crank chamber 15 into the gas passage 53 is restricted.

In the blow-by gas drawn from the small-diameter portion 54 to the large-diameter portion 55 of the gas passage 53, the blow-by gas that flows near the inner surface of the large-diameter portion 55 is swirled by the rotation of the drive shaft 16. This centrifugally separates the lubricating oil from the blow-by gas that flows near the inner surface of the large-diameter portion 55. The lubricating oil centrifugally separated in the large-diameter portion 55 collects on the inner surface of the large-diameter portion 55 and is then returned to the crank chamber 15 through the second gas inlet passages 57 as the drive shaft 16 rotates.

Consequently, when the displacement of the compressor 10 is between the minimum and maximum displacements and the blow-by gas increases to a certain amount, the amount of refrigerant gas that bleeds through the first gas inlet passages 56 is restricted. Thus, the amount of lubricating oil that is carried by the refrigerant gas from the crank chamber 15 to the suction chamber 45 is also restricted. In this state, the lubrication of the plane bearing 18, the lip seal 22, and the thrust bearing 27 is ensured by the lubricating oil that is carried by the refrigerant gas mainly including blow-by gas. At the same time, the proportion of the lubricating oil in the refrigerant gas is prevented from increasing in the external refrigerant circuit. As a result, the cooling capacity of the external refrigerant circuit is prevented from being decreased since the proportion of the lubricating oil does not increase.

(Maximum Displacement Operation)

When the solenoid control valve controls the internal pressure of the crank chamber 15 so that the inclination angle of the swash plate 28 becomes maximal (maximum inclination range) as shown in the state of FIG. 2, the displacement of the compressor 10 becomes maximal. In this state, each of the second gas inlet passages 57 are closed, as shown in FIG. 5(*c*), by the abutment portion 31 of the sleeve 30, which is moved towards the front of the drive shaft 16. Thus, the second gas inlet passages 57 disconnect the gas passage 53 from the crank chamber 15.

In this state, the stroke of the pistons 37 is maximal. Therefore, the amount of the blow-by gas also becomes maximal. In the same manner as during the minimum displacement operation, the crank chamber 15 is connected to the suction chamber 45 through the first gas inlet passages 56, the gas passage 53, the inner space of the oil separator 60, and the orifice 59. Therefore, some of the blow-by gas reaching the inner surface of the front wall 17 of the front housing 12-is drawn from the annular groove 24 into the oil chamber 23 through the oil passage 25. The blow-by gas is then further drawn from the oil chamber 23 into the gas passage 53 through the first gas inlet passages 56. Thus, the amount of the lubricating oil carried out of the crank chamber 15 to the suction chamber 45 by the blow-by gas introduced into the gas passage 53 is greater than the amount of the lubricating oil that would be carried out if the second gas inlet passages 57 were opened during the maximum displacement operation.

Accordingly, when the displacement of the compressor 10 is controlled to be maximal, the amount of refrigerant gas that bleeds through the first gas inlet passages 56 is not restricted. Thus, the amount of lubricating oil that is carried by the refrigerant gas from the crank chamber 15 to the suction chamber 45 is not restricted. For this reason, the proportion of the lubricating oil in the refrigerant gas in the suction chamber 45, the discharge chamber 46, and the external refrigerant circuit is prevented from being excessively reduced. This prevents insufficient lubrication of the suction chamber 45, the discharge chamber 46, and the external refrigerant circuit.

Figure 6:
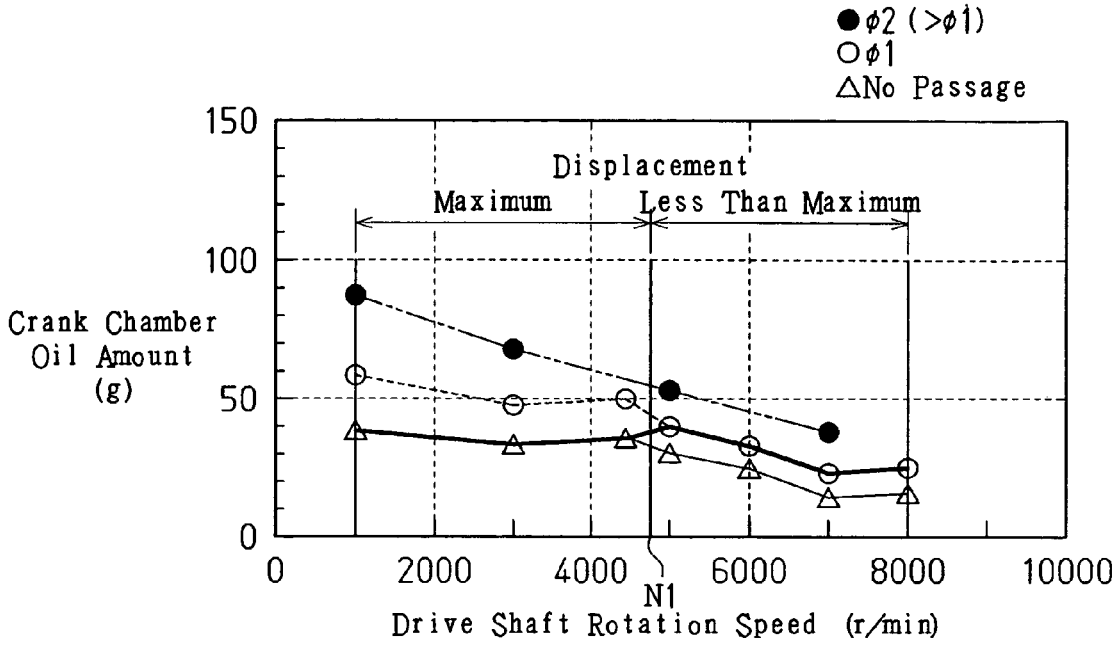
FIG. 6 is a graph showing the relationship between the amount of lubricating oil in a crank chamber and the rotation speed of the drive shaft.

The graph of FIG. 6 shows the result of an experiment conducted to measure the amount of lubricating oil collected in the crank chamber 15 at different rotation speeds of the drive shaft 16. This experiment was performed to measure the amount of lubricating oil collected in the crank chamber 15 using a compressor 10, which does not have any second gas inlet passages 57 in the drive shaft 16, and two other compressors 10, which have drive shafts 16 with second gas inlet passages 57 of different diameters. In this experiment, the cooling load was kept fixed, and the displacement of each compressor 10 was controlled to be maximal when the rotation speed of the drive shaft 16 was less than a predetermined rotation speed N1. Accordingly, when the rotation speed of the drive shaft 16 was less than N1, the operation of each compressor 10 was controlled to constantly keep the displacement maximal. When the rotation speed of the drive shaft 16 was N1 or higher, the operation of each compressor 10 was controlled so that the displacement was less than the maximum displacement. Thus, the experiment simulated the conditions of normal use of the compressors 10 in a simplified manner.

In the case of the compressor 10 having no second gas inlet passage 57 in the drive shaft 16, the amount of lubricating oil that collects in the crank chamber 15 decreases as the rotation speed of the drive shaft 16 increases, as shown by the thin solid line in FIG. 6 (plotted with the triangles) Accordingly, the amount of lubricating oil is greater in the range in which the rotation speed is less than N1 and the displacement is maximal compared to the range in which the rotation speed is N1 or higher and the displacement is less than the maximum displacement.

In the case of the compressor 10 in which the second gas inlet passages 57 in the drive shaft 16 have a small diameter Ø1, the amount of lubricating oil that collects in the crank chamber 15 decreases as the rotation speed of the drive shaft 16 increases, as shown by the broken line in FIG. 6 (plotted with the white circles). Further, the amount of lubricating oil that collects in the crank chamber 15 is greater than that in the compressor 10 having no second gas inlet passage 57 regardless of the rotation speed. Also in this case, the amount of lubricating oil is greater in the range in which the rotation speed is less than N1 and the displacement is maximal compared to the range in which the rotation speed is N1 or higher and the displacement is less than the maximum displacement.

In the case of the compressor 10 in which the second gas inlet passages 57 have a large diameter Ø2 (>Ø1), the amount of lubricating oil that collects in the crank chamber 15 decreases as the rotation speed of the drive shaft 16 increases, as shown by the double dotted line in FIG. 6 (plotted with the black circles). Further, the amount of lubricating oil that collects in the crank chamber 15 is greater than that in the compressor 10 having the second gas inlet passages 57 with the smaller inner diameter Ø1 regardless of the rotation speed. In this case as well, the amount of lubricating oil is greater in the range in which the rotation speed is less than N1 and the displacement is maximal compared to the range in which the rotation speed is N1 or higher and the displacement is less than the maximum displacement.

Accordingly, the amount of lubricating oil that is carried by the blow-by gas from the crank chamber 15 to the suction chamber 45 is more restricted in the compressor 10 with the second gas inlet passages 57 in the drive shaft 16 compared to the compressor having no second gas inlet passage 57. Thus, the proportion of the lubricating oil in the refrigerant gas is prevented from increasing in the suction chamber 45, the discharge chamber 46, and the external refrigerant circuit.

If the percentage of the lubricating oil that collects in the crank chamber 15 relative to the total amount of lubricating oil present in the compressor 10 and the external refrigerant circuit becomes excessively high, the proportion of the lubricating oil in the refrigerant gas would become too low. This would result in insufficient lubrication of components, such as, a check valve arranged in the discharge chamber 46 at a discharge port connected to the external refrigerant circuit or an expansion valve arranged in the external refrigerant circuit.

The present embodiment solves this problem by closing all the second gas inlet passages 57 with the sleeve 30 when the displacement is maximal in addition to when the displacement of the compressor 10 is minimal. Thus, as shown by the thick solid line in FIG. 6, when the rotation speed is less than N1, the amount of lubricating oil that collects in the crank chamber 15 changes in the same manner as the compressor having no second gas inlet passage 57. When the rotation speed is N1 or higher, the amount of lubricating oil changes in the same manner as the compressor 10 having the second gas inlet passages 57 (e.g., the inlet passages 57 with the inner diameter Ø1). Accordingly, even if the compressor 10 has the second gas inlet passages 57, by closing the second gas inlet passages 57, there would be no restrictions on the amount of blow-by gas that bleeds from the crank chamber 15 to the suction chamber 45 when the displacement of the compressor is maximal. Thus, the amount of lubricating oil carried by the blow-by gas from the crank chamber 15 to the suction chamber 45 would not be restricted.

The compressor of the present embodiment has the advantages described below.

(1) The compressor 10 of the present embodiment is designed so that, during the minimum displacement operation, refrigerant gas mainly including blow-by gas bleeds from the front of the crank chamber 15 through the first gas inlet passages 56 and the gas passage 53. Therefore, when the clutchless compressor 10 substantially stops operating and the amount of blow-by gas is minimal, lubricating oil is more positively supplied, by the bleeding refrigerant gas, to the plane bearing 18, the lip seal 22, and the thrust bearing 27 which are located in front of the crank chamber 15. When the displacement is controlled to be greater than the minimum displacement, refrigerant gas mainly including blow-by gas bleeds from the first gas inlet passages 56 and also from the central part of the crank chamber 15 through the second gas inlet passages 57 and the gas passage 53. Accordingly, when the compressor 10 operates in a manner that further increases the amount of blow-by gas, the amount of lubricating oil carried by the refrigerant gas that bleeds from the crank chamber 15 to the suction chamber 45 is lowered while ensuring the lubrication of the plane bearing 18, the lip seal 22, and the thrust bearing 27.

Consequently, when the clutchless compressor 10 substantially stops operating, the crank chamber 15 is lubricated in a further satisfactory manner. Further, during operation of the compressor 10, the proportion of the lubricating oil in the refrigerant gas is prevented from being increased in the external refrigerant circuit so as not to lower the cooling efficiency.

(2) When the displacement of the compressor 10 is controlled to be maximal, the second gas inlet passages 57 are closed in the same manner as when the displacement is minimal so that the refrigerant gas mainly including blow-by gas bleeds through the first gas inlet passages 56 and the gas passage 53. Therefore, the amount of the refrigerant gas drawn into the gas passage 53 through the first gas inlet passages 56 is not restricted. Consequently, during the maximum displacement operation of the compressor 10 when the percentage of the lubricating oil that collects in the crank chamber 15 is the highest, there are no restrictions on the amount of lubricating oil carried from the crank chamber 15 into the suction chamber 45 by the refrigerant gas drawn into the gas passage 53 through the first gas inlet passages 56. Thus, the proportion of the lubricating oil in the refrigerant gas is prevented from becoming excessively low in the suction chamber 45, the discharge chamber 46, and the external refrigerant circuit. This prevents insufficient lubrication of components in the refrigerant circuit, such as a check valve and an expansion valve.

(3) The large-diameter portion 55 in the gas passage 53 of the drive shaft 16 centrifugally separates the lubricating oil from the refrigerant gas that mainly includes blow-by gas drawn into the gas passage 53 through the first gas inlet passages 56. The separated lubricating oil is returned to the crank chamber 15 through the second gas inlet passages 57. Accordingly, during operation of the compressor 10, the amount of the lubricating oil carried by the bleeding refrigerant gas from the crank chamber 15 to the external refrigerant circuit is reduced further effectively. Since the lubricating oil proportion of the refrigerant gas in the external refrigerant circuit does not increase, the cooling efficiency is prevented from being lowered.

It should be apparent to those skilled in the art that the present invention may be embodied in many other specific forms without departing from the spirit or scope of the invention. Particularly, it should be understood that the present invention may be embodied in the following forms.

Figure 7:
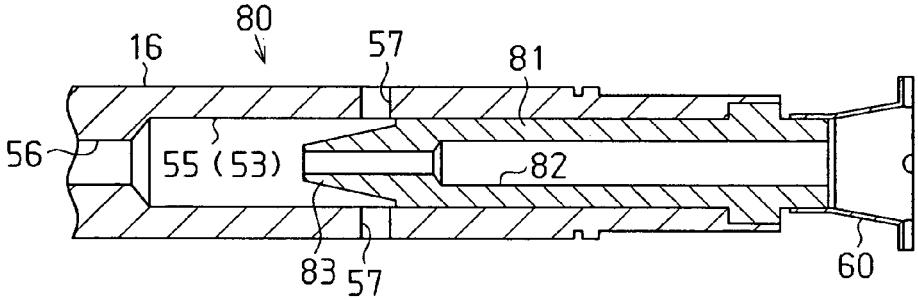
FIG. 7 is a cross-sectional view showing part of a drive shaft according to another embodiment of the present invention.

A lubricating oil separation mechanism 80 as shown in FIG. 7 may be arranged in the interior of the drive shaft 16. The lubricating oil separation mechanism 80 includes a tubular body 81, which is fitted in and fixed to the large-diameter portion 55. A gas passage 82 axially extends through the tubular body 81. The tubular body 81 further has a guide portion 83, the diameter of which is enlarged from the front towards the rear at a position corresponding to the second gas inlet passages 57. In this structure, lubricating oil, which has been centrifugally separated from the refrigerant gas in the large-diameter portion 55, is guided by the guide portion 83 to the second gas inlet passages 57 and subtly enters the gas passage 82 of the tubular body 81. The lubricating oil is then discharged into the crank chamber 15 through the second gas inlet passages 57. The refrigerant gas from which the lubricating oil has been separated is discharged into the suction chamber 45 through the gas passage 82 of the tubular body 81. During operation of the compressor 10, this structure separates lubricating oil from the refrigerant gas drawn into the gas passage 53 and returns the separated lubricating oil to the crank chamber 15 in a more effective manner.

Figure 8:
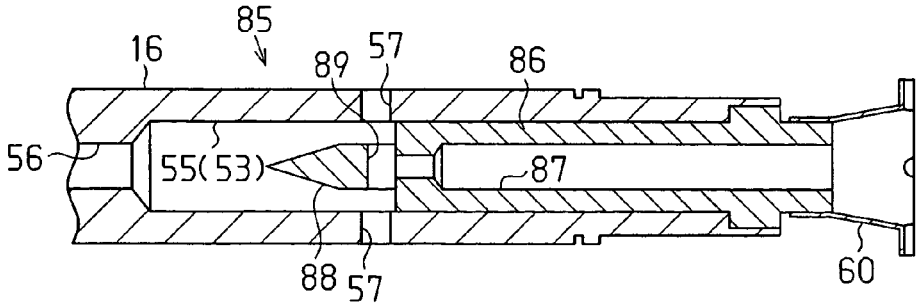
FIG. 8 is a cross-sectional view showing part of a drive shaft according to a further embodiment of the present invention.

A lubricating oil separation mechanism 85 as shown in FIG. 8 may be arranged in the drive shaft 16. The mechanism includes a tubular body 86, which is fitted and fixed in the large-diameter portion 55. A gas passage 87 axially extends through the tubular body 86. The tubular body 86 further has a guide portion 88, which projects towards the front of the compressor 10 at a position corresponding to the second gas inlet passages 57. The guide portion 88 is conical and includes an inlet passage 89, which opens in the basal outer surface of the guide portion 88 and connects to the gas passage 87. In this structure, the lubricating oil centrifugally separated from refrigerant gas in the large-diameter portion 55 is guided by the guide portion 88 to the second gas inlet passages 57 and subtly enters the gas passage 87 of the tubular body 86. The lubricating oil is then discharged into the crank chamber 15 through the second gas inlet passages 57. The refrigerant gas from which the lubricating oil has been separated is drawn into the gas passage 87 through the inlet passage 89 and discharged into the suction chamber 45 from the gas passage 87. During operation of the compressor 10, this structure separates lubricating oil from the refrigerant gas drawn into the gas passage 53 and returns the separated lubricating oil to the crank chamber 15 in a more effective manner.

Figure 9A:
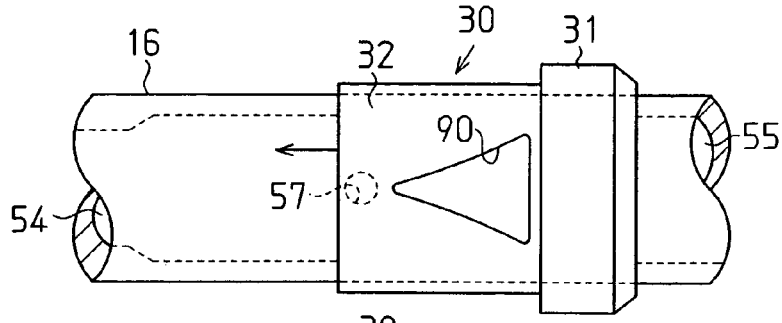
FIGS. 9(*a*), 9(*b*), and 9(*c*) are front views showing a sleeve and a drive shaft according to further embodiments of the present invention.
Figure 9B:
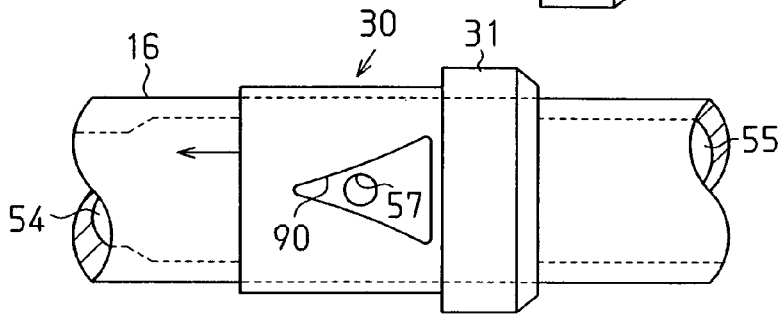
Figure 9C:
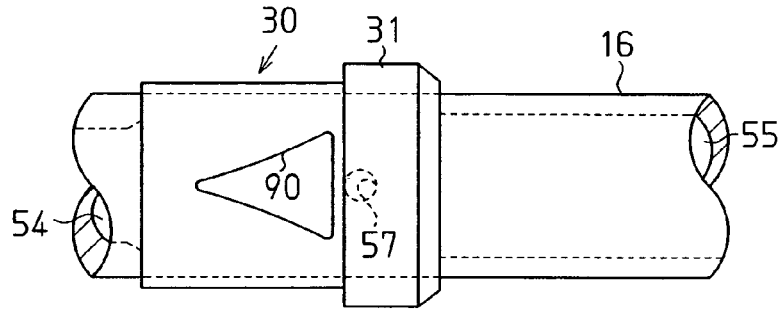

The sleeve 30 may be provided, for example, as shown in FIGS. 9(*a*), 9(*b*), and 9(*c*), with an opening 90 in which the width (length is defined along the circumferential direction) continuously increases in the axial direction of the sleeve 30. In this case, as shown by the arrow, the open amount of each second gas inlet passage 57 is gradually increased from a closed state as the inclination angle of the swash plate 28 increases from the minimum angle. In this case, the sleeve 30 does not rotate relative to the drive shaft 16.

In this structure, the amount of refrigerant gas drawn from the second gas inlet passages 57 into the gas passage 53 is gradually increased from a null state when the displacement increases from the minimum displacement. This gradually reduces the amount of refrigerant gas that bleeds from the front of the crank chamber 15. Therefore, the amount of lubricating oil supplied to the plane bearing 18, the thrust bearing 27, and the lip seal 22 by the refrigerant gas mainly including blow-by gas gradually decreases when the displacement is gradually increased from the minimum displacement. This prevents sudden decrease of the lubricating oil.

Figure 10:
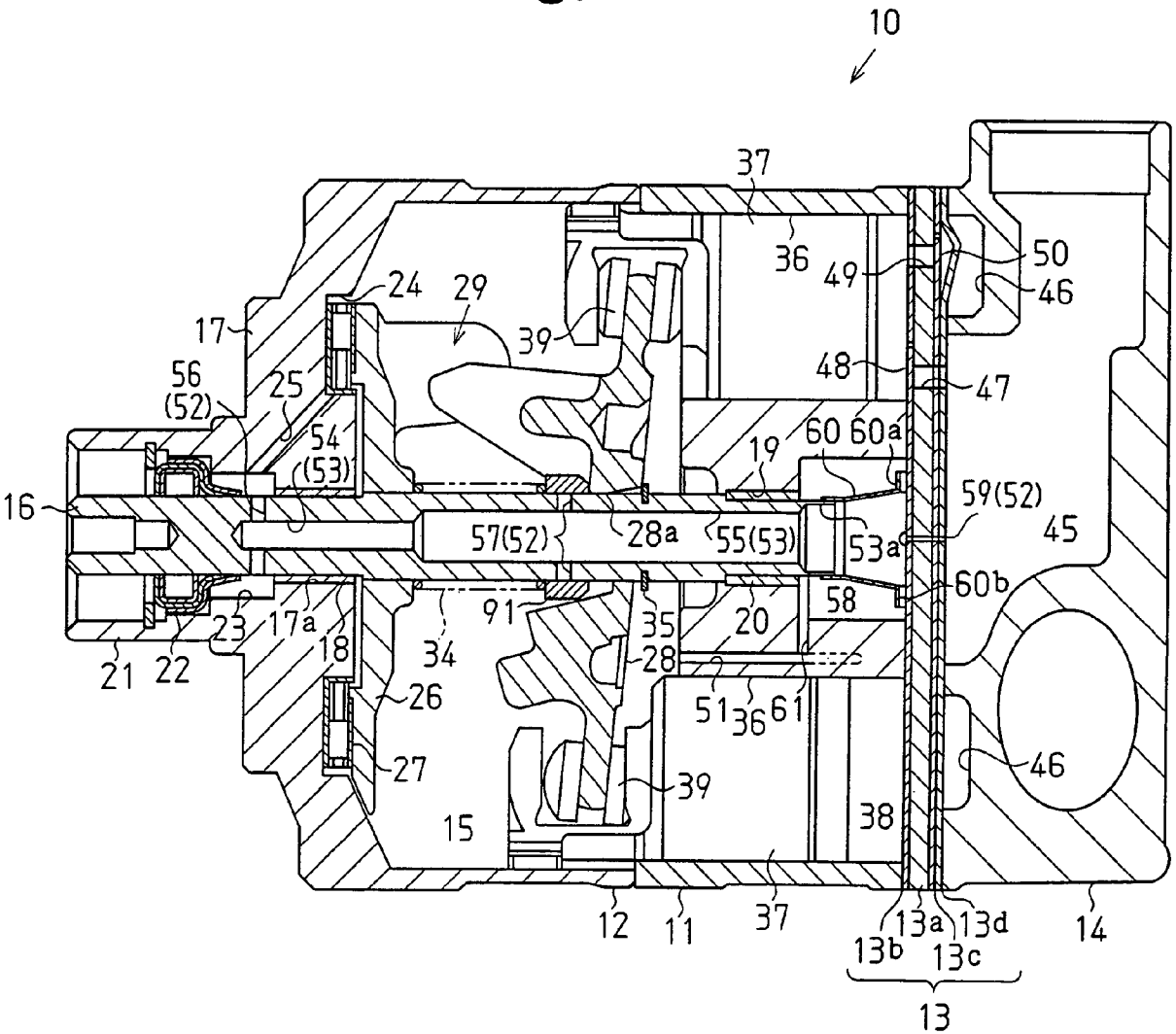
FIG. 10 is a cross-sectional view showing a compressor according to a further embodiment of the present invention.
Figure 11:
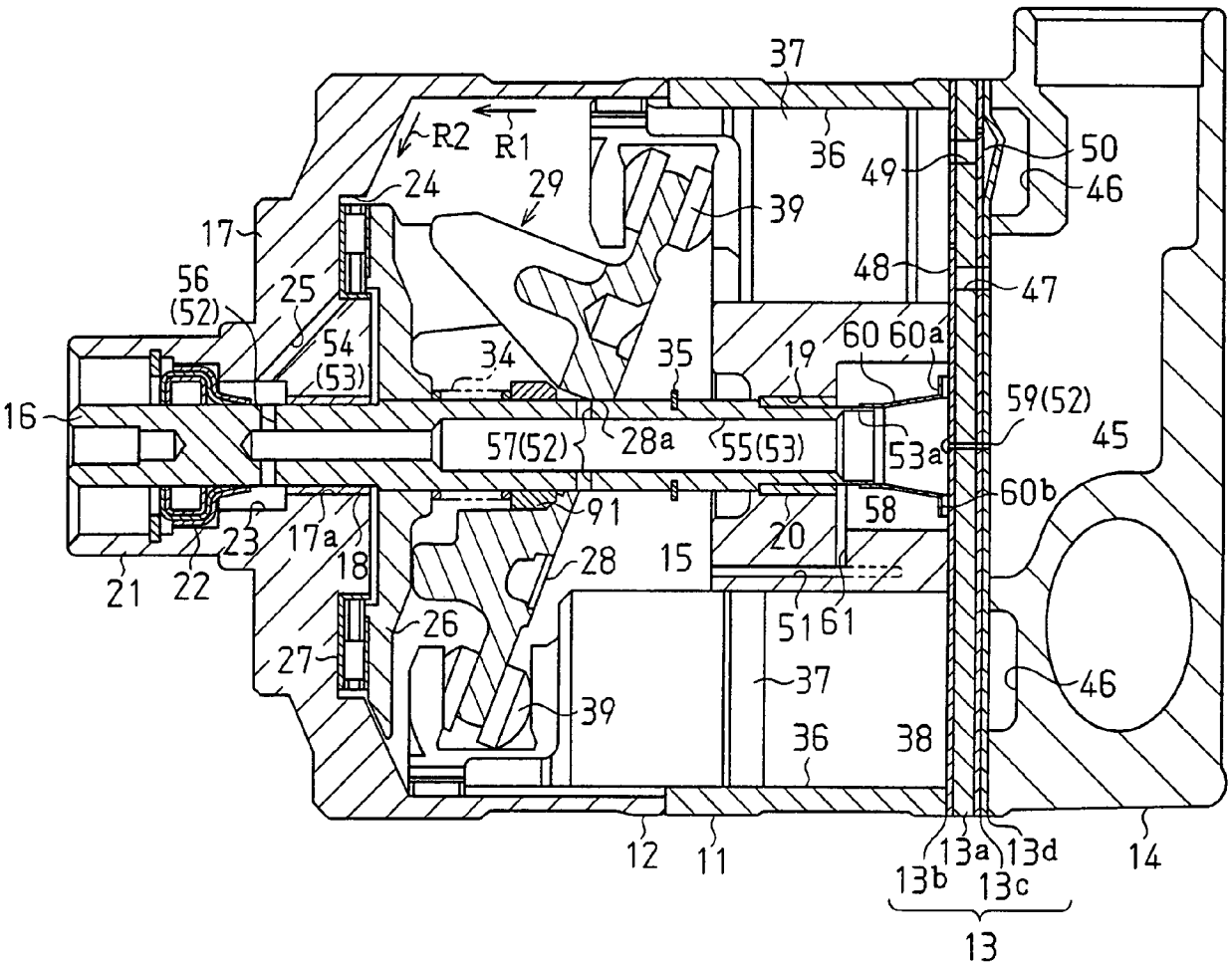
FIG. 11 is a cross-sectional view showing the compressor in FIG. 10 in a state in which the inclination angle of a swash plate is minimal.

As shown in FIGS. 10 and 11, the compressor may have a sleeve 91 designed to close the second gas inlet passages 57 only when the inclination angle of the swash plate 28 is minimal. FIG. 10 shows a state in which the inclination angle of the swash plate 28 is maximal.

The present invention may be embodied in a variable displacement compressor that does not include the oil separator 60.

The present invention may be embodied in a wobble-type variable displacement compressor in which a wobble plate is supported by a drive plate, or cam plate, coupled to a lug plate such that the wobble plate is rotatable relative to the drive plate. In this compressor, the wobble plate is connected to pistons by a connecting rod.

The present examples and embodiments are to be considered as illustrative and not restrictive, and the invention is not to be limited to the details given herein, but may be modified within the scope and equivalence of the appended claims.

What is claimed is:

1. A variable displacement compressor for use with a refrigerant gas, the variable displacement compressor comprising:

a cam plate;

a crank chamber including a drive shaft and a piston in which the cam plate is arranged in the crank chamber for operably connecting the drive shaft and the piston, wherein the crank chamber is supplied with the refrigerant gas at high pressure from a refrigerant gas discharge region while refrigerant gas bleeds from the crank chamber to a suction chamber through a bleed passage so as to adjust internal pressure of the crank chamber, the cam plate being adjustable to incline at an inclination angle that is in accordance with the internal pressure of the crank chamber in order to change the stroke of the piston;

a gas passage formed in the drive shaft, extending in an axial direction of the drive shaft, and connected to the suction chamber;

a bearing device and a seal device arranged at a front end portion of the drive shaft;

an oil lubrication passage for lubricating the bearing device and the seal device;

a first gas inlet passage connecting the gas passage and the crank chamber via the oil lubrication passage;

a second gas inlet passage directly connecting the gas passage and the crank chamber; and a sleeve supported on the drive shaft and moved in the axial direction of the drive shaft as the cam plate inclines to change an open amount of the second gas inlet passage, the open amount of the second gas inlet passage being changed by the sleeve to adjust the amount of refrigerant gas drawn into the gas passage through the first gas inlet passage, wherein flow of the refrigerant gas between the gas passage and the crank chamber through the second gas inlet passage is substantially completely disconnected when the cam plate is adjusted to incline at a maximum inclination angle to cause the sleeve to close the second gas inlet passage.

2. The variable displacement compressor according to claim 1, wherein the sleeve closes the second gas inlet passage when the cam plate is adjusted to incline at a minimum inclination angle so that flow of the refrigerant gas between the gas passage and the crank chamber through the second gas inlet passage is substantially completely disconnected.

3. The variable displacement compressor according to claim 1, wherein the open amount of the second gas inlet passage continuously changes as the inclination angle of the cam plate changes between a minimum inclination angle and a maximum inclination angle.

4. The variable displacement compressor according to claim 1, wherein the gas passage includes a lubricating oil separation mechanism for separating lubricating oil from the refrigerant gas drawn into the gas passage through the first gas inlet passage using centrifugal force produced by rotation of the drive shaft and for discharging the separated lubricating oil into the crank chamber through the second gas inlet passage.

5. The variable displacement compressor according to claim 1, wherein the sleeve includes:

a first closing portion for closing the second gas inlet passage when the cam plate is inclined to a minimum inclination angle;

a second closing portion for closing the second gas inlet passage when the cam plate is inclined to a maximum inclination angle; and an exposing portion for opening the second gas inlet passage when the cam plate is inclined to an angle between the minimum and maximum inclination angles, the exposing portion being located between the first and second closing portions.

6. The variable displacement compressor according to claim 5, wherein the exposing portion of the sleeve is an opening.

7. The variable displacement compressor according to claim 6, wherein the opening of the sleeve is rectangular.

8. The variable displacement compressor according to claim 6, wherein the opening of the sleeve is triangular.

9. The variable displacement compressor according to claim 1, further comprising a spring for biasing the sleeve towards the cam plate.

10. The variable displacement compressor according to claim 4, wherein the gas passage includes a small-diameter portion and a large-diameter portion connected to the small-diameter portion, the large-diameter portion forming the lubricating oil separation mechanism.

* * * * *